United States Patent [19]

Vandervaart

[11] 4,442,890

[45] Apr. 17, 1984

[54] HEAT EXCHANGER HOUSING WITH FAN OPERATED DOOR

[75] Inventor: Gerry Vandervaart, Niagara Falls, Canada

[73] Assignee: Kool-Fire Limited, Niagara Falls, Canada

[21] Appl. No.: 269,946

[22] Filed: Jun. 3, 1981

[51] Int. Cl.[3] ..... F28F 9/22

[52] U.S. Cl. ..... 165/124; 165/122; 312/236

[58] Field of Search ..... 165/29, 122, 124; 98/116; 312/214, 236; 62/238.6

[56] References Cited

U.S. PATENT DOCUMENTS

| | | | |
|---|---|---|---|
| 1,894,930 | 1/1933 | Hueglin | 98/116 |
| 2,776,118 | 1/1957 | Davis | 165/122 X |
| 3,157,227 | 11/1964 | Palmer | 165/29 |
| 3,826,105 | 7/1974 | Marsteller | 98/116 X |
| 4,103,146 | 7/1978 | Rampe | 165/122 X |
| 4,141,490 | 2/1979 | Franchina | 62/238.6 X |
| 4,293,032 | 10/1981 | Asp | 165/122 X |

FOREIGN PATENT DOCUMENTS

| | | | |
|---|---|---|---|
| 1042154 | 10/1953 | France | 165/122 |

*Primary Examiner*—William R. Cline
*Assistant Examiner*—John M. Kramer
*Attorney, Agent, or Firm*—Diller, Ramik & Wight

[57] ABSTRACT

This disclosure is directed to a heat exchanger which includes a coil through which a heat exchange medium is circulated, the coil being located in one of a pair of chambers, a fan in the same chamber as the coil but located therebeneath, a partition separating the two chambers with an opening therein through which air driven by the fan can be drawn from the first chamber and introduced into the second chamber, and a door normally closing the second chamber and hinged to open under the influence of air emitted from the fan to thereby effectively create air flow during a non-heat-augmented operation of the heat exchanger.

28 Claims, 4 Drawing Figures

3
4
16
70
61
34
22
36
40
38
42
44
37
41
43
32
33
F
S1
17
63
64
65
39
26
25
S2
S3
54
73
72
21
35
30
28
15
71
S 16
34
S2
S3
22
17
61
62
18
70
S1
26

HEAT EXCHANGER HOUSING WITH FAN OPERATED DOOR

The present invention is directed to a novel heat exchanger which forms an improvement of the "Heat-Augmented Heat Exchanger" disclosed in applicant's corresponding U.S. patent applications, Ser. Nos. 54,647 and 87,154 filed on July 3, 1979 and Oct. 22, 1979, respectively, and now U.S. Pat. Nos. 4,311,191 and 4,311,192.

The latter-noted applications disclose a heat exchanger in which an outdoor coil is subjected to heat other than ambient air by, for example, a gas burner. The gas burner is housed beneath an "A-coil" and directs flames upwardly with the heat thereof being absorbed by the heat exchange medium of the "A-coil". This is termed the heat-augmented mode of operation of the heat exchanger during which a fan is de-energized. However, in other than the heat-augmented mode of operation, the fan is energized to draw ambient air from exteriorly of the housing, into the housing, through the "A-coil", and thence discharge the heat-depleted air exteriorly of the housing. The latter is achieved by locating an outlet of the fan in a partition between two chambers and in alignment with a door which is normally closed, but upon the operation of the fan, an air stream generated thereby impinges against the door and pivots the same to an opened position.

A further object of this invention is to provide a novel housing for a heat exchanger of the type just described wherein means are provided for restricting the flow of air into the first chamber when the fan is inoperative and a gas burner is operative to preclude wind exteriorly of the heat exchanger housing from entering the same and extinguishing the flames, while at the same time permitting the introduction of a relatively high volume of air into the housing upon the operation of the fan and the de-energization of the gas burner.

Still another object of this invention is to provide a novel housing for a heat exchanger in the manner just described wherein the "A-coil", the gas burner and the fan are located in one chamber with the gas burner disposed generally between the "A-coil" and the fan, and the compressor being housed in the second chamber whereby air is drawn thereover to cool the same during the nonheat-augmented mode of operation of the heat exchanger.

With the above and other objects in view that will hereafter appear, the nature of the invention will be more clearly understood by reference to the following detailed description, the appended claims and the several views illustrated in the accompanying drawings.

IN THE DRAWINGS

FIG. 1 is a perspective view of a novel heat exchanger constructed in accordance with this invention, and illustrates a housing which includes a partition setting off a pair of chambers above which is a cover, and a fan having an outlet directed toward a hinged door such that upon the operation of the fan, air is drawn through an associated "A-coil" and blown toward and against the hinged door to open the same.

Figure 1:
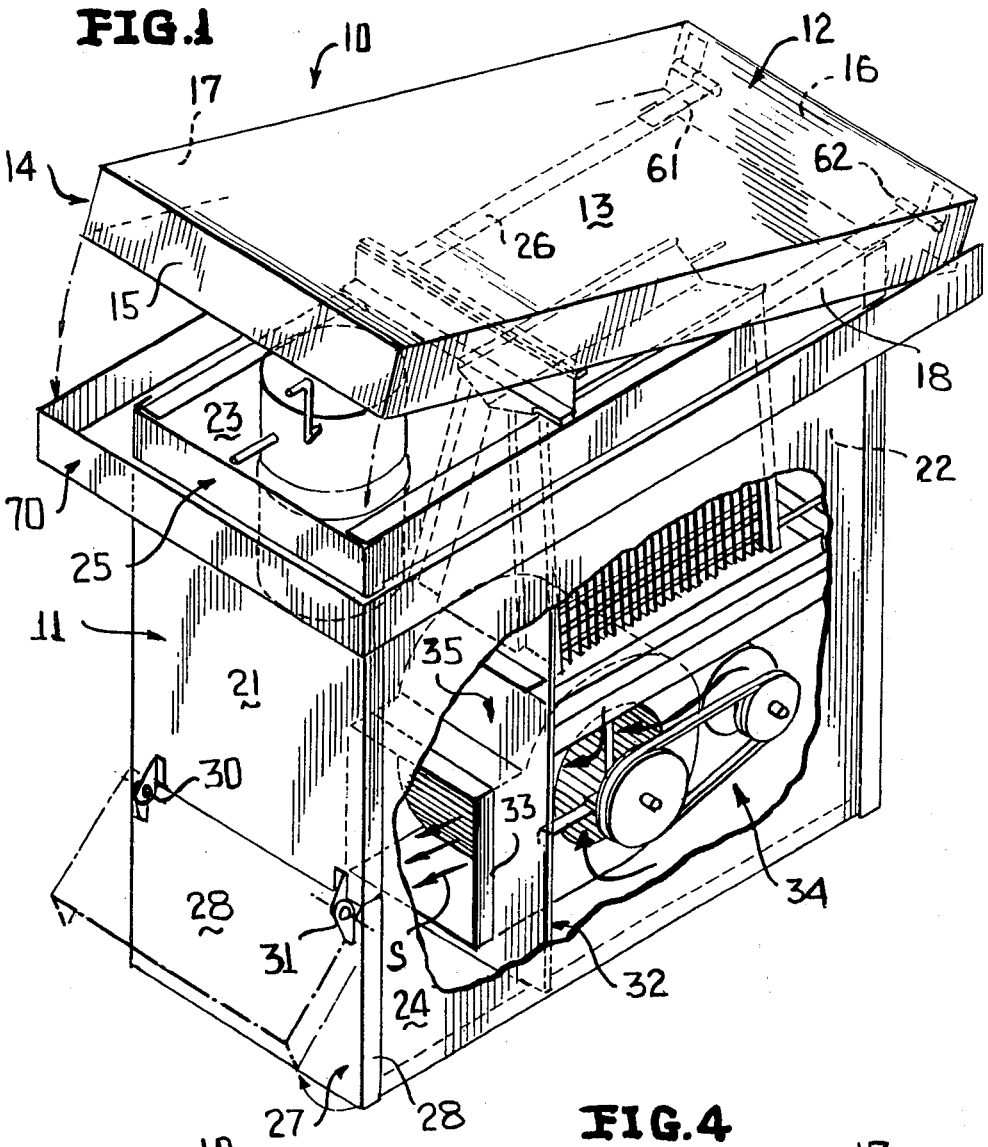

A novel heat exchanger constructed in accordance with this invention is generally designated by the reference numeral 10 and includes as part thereof a housing 11 and a cover 12.

The cover 12 includes an end wall 13 and a peripheral wall 14 with the latter being defined by opposite generally parallel end panels 15, 16 and opposite generally parallel side panels 17, 18.

The housing 11 includes a pair of offset upstanding generally parallel end panels 21, 22 (FIGS. 1 and 2) and opposite upstanding generally parallel side panels 23, 24. The panels 21 through 24 are united in a conventional manner as by nuts, sheet metal screws, bolts and the like and collectively define an upper peripheral end portion 25 of the housing 11 terminating in an upper peripheral terminal edge 26. The end panel 21 is shorter than the end panel 22 (FIGS. 1 and 2) and thereby defines a generally rectangular opening 27 which is normally closed by means in the form of a generally rectangular door 28 which is connected for free pivoting or hinging action to the panel 21 by conventional hinges 30, 31 having respective hinge halfs (unnumbered) secured to the end panel 21 and to the door or closing means 28. The door 28 normally lies in the same plane as the end panel 21, as is shown in solid lines in FIG. 1, but can be moved to the phantom outline position shown in FIG. 1 by a stream S of air which is created by a fan or blower 43 which will be described more fully hereinafter.

Means generally designated by the reference numbral 32 is a partition wall which is disposed in spaced parallel upstanding relationship to the panels 21, 22 and includes at a lowermost portion thereof a generally rectangular opening 33. The partition wall or panel 32 sets off a pair of compartments or chambers 34, 35 with the chamber 34 being further divided into upper and lower chamber portions (unnumbered) by a generally horizontally disposed partition or plate 36 having a central opening 37 surrounded by a generally annular reservoir 38 in which rests a lower end portion (unnumbered) of an "A-coil" 40. A gas burner 41 is operative in the manner more fully disclosed in the latter-noted applications and when conventionally ignited by an electric igniter generates flames F during the heat-augmenting mode of operation of the heat exchanger 10 during which operation of a motor 42 is de-energized and, thus, the fan 43 will not rotate through the now inoperative drive connection of a fan belt 44. The nonheat-augmenting mode of operation of heat exchanger 10 simply means that during a heating cycle of operation at relatively moderate ambient outdoor temperatures, the fan 43 is operated to draw outside ambient air into the chamber 34 through spaces to be defined more fully hereinafter between the cover 12 and the upper peripheral edge portion 25 of the housing 11, as is indicated by the unnumbered headed arrows in FIG. 2, through the "A-coil" 40, into the blower 43, out of the blower outlet and along the air stream S to open the door 28 thereby circulating air through the housing 11 in a highly efficient manner while assuring that the door 28 will close when the fan 43 is inoperative. The latter precludes high exterior air movement, such as high winds, from entering the now closed opening 26 and, for example, extinguishing or blowing out the flames F when the heat exchanger is in its heat-augmenting mode of operation.

It should be also noted that when the fan 43 is operative, air is drawn downwardly through the chamber 35 past a conventional compressor 39 and this continuous air flow past the exterior of the compressor 39 during the operation of the fan 43 assists in maintaining the compressor 39 cooler and thus more efficient than might otherwise be the case without such air flow.

Figure 2:
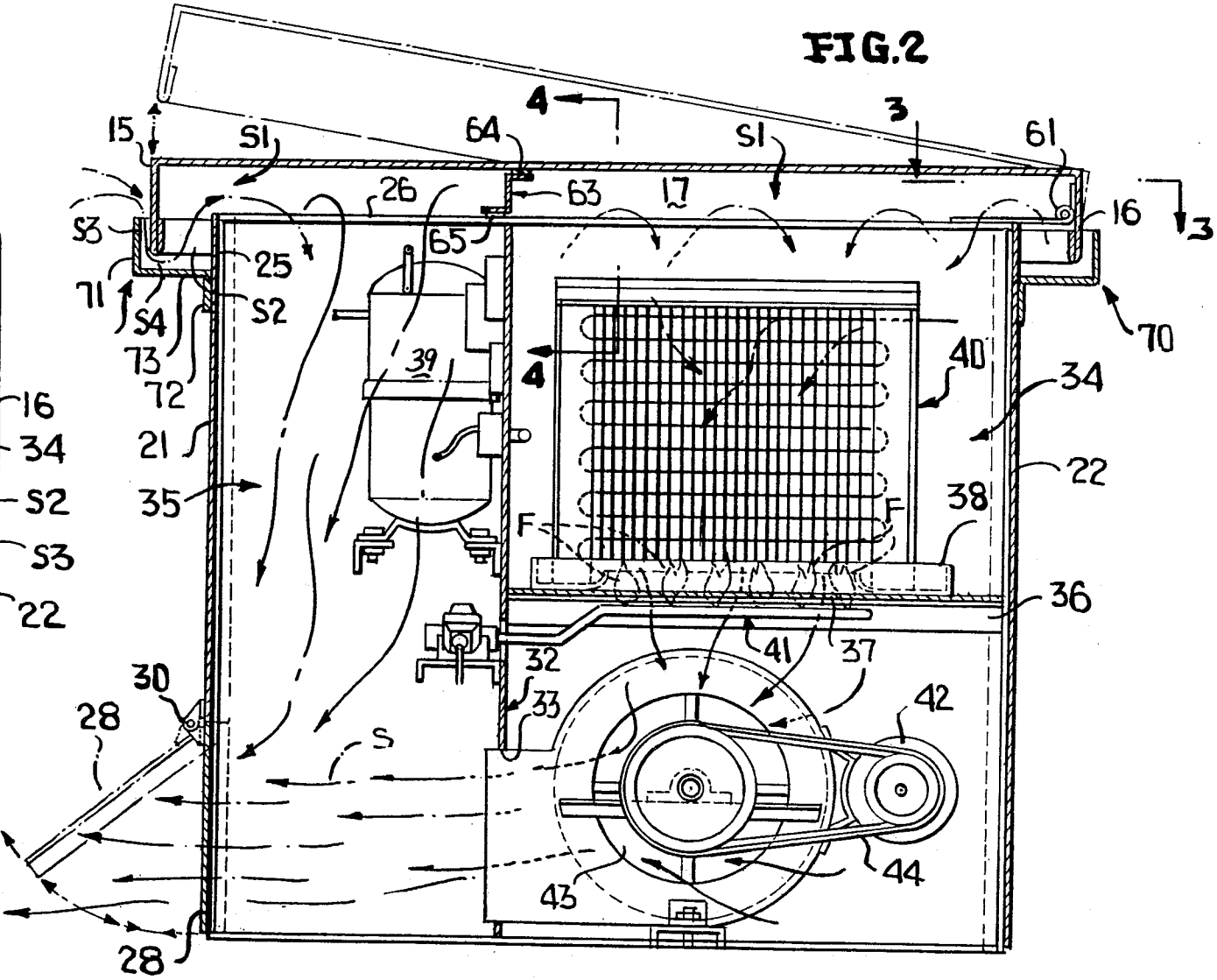
FIG. 2 is a longitudinal sectional view taken through the heat exchanger of FIG. 1, and illustrates more clearly the manner in which air travels through the heat exchanger and the hinged door is blown open during the operation of the heat exchanger in its nonheat-augmented mode of operation.
Figure 3:
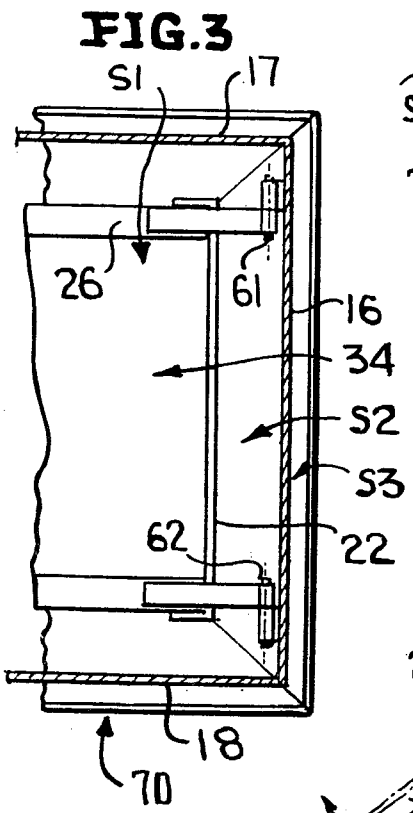
FIG. 3 is a cross-sectional view taken generally along line 3—3 of FIG. 2, and illustrates a pair of hinges connecting the cover to the housing.

The cover 13 is secured to the upper peripheral end portion 25 and more specifically to the terminal edge 26 of the housing 11 by a pair of hinges 61, 62 which facilitate the pivoting or hinging of the cover 12 from its closed (solid line position in FIGS. 2 through 4) to its open position (solid outline in FIG. 1 and phantom outline in FIG. 2). The cover 12 can be pivoted about the hinges 61, 62 to an almost upright position to gain access to the interior of the housing 11, but only a partial open position is illustrated for convenience, and the degree of opening of the cover 12 is of no moment relative to the present invention.

Figure 4:
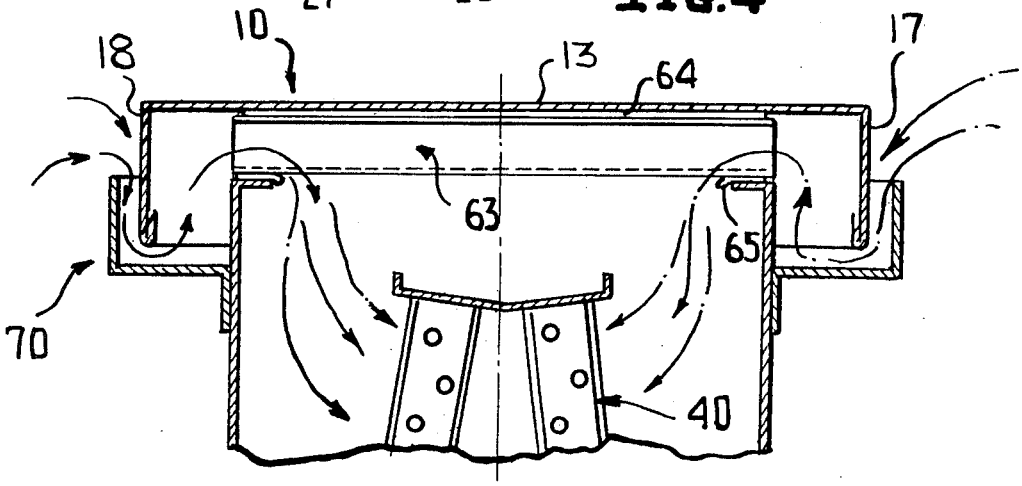
FIG. 4 is a fragmentary sectional view taken generally along line 4—4 of FIG. 2, and illustrates the manner in which the air drawn into the housing is also drawn through the "A-coil" by the fan positioned therebeneath.

A central portion of the cover 12 is supported by a cover support merber 63 which traversely spans and is seated upon the upper peripheral terminal edge 26 of the housing 11, and is thereat bolted to the side panels or walls 22, 23. The cover support member is generally Z-shaped in transverse cross-section (FIG. 2) and includes an upper strip of sound damping or deadening materials 64 and a lower strip of sound damping material 65, respectively, sandwiched between flanges (unnumbered) of the cover support member 63 and the end panel 13 and the upper terminal edge 26. The end panel 13 of the cover 12 rests upon the strip 64 of sound damping material and, of course, the function of the cover support member 63 is to maintain the cover 12 spaced from the upper end portion 25 of the housing 11 to permit air to be drawn through such spacing in the manner earlier described. More specifically, the cover support member 63 supports the end wall or panel 13 above the terminal peripheral edge 26 such as to define a space S1 therebetween (FIGS. 2 and 4). Furthermore, since the peripheral skirt 14 of the cover 12 is larger than that of the upper peripheral portion 25 of the housing 11, the latter two elements (14 and 25) collectively define therebetween a space S2 which is, of course, in communication with the space S1 about the entire periphery or upper terminal edge portion 26 of the housing 11, and in the absence of other structure would permit generally unrestricted air flow from the exterior of the housing 11 into the chambers 34, 35 through the spaces S1, S2.

In keeping with the present invention, it is necessary that the air can be drawn into the interior of the housing 11 between the peripheral upper wall portion 25 and the cover 12 during the nonheat-augmented mode of operation of the heat exchanger 10 (flames F extinguished) during which time the fan 43 is operative and the door 28 is blown open, but it is also equally imperative that when the flames F are being generated by the burner 41, the door 28 is closed. Thus, both modes of operation (heat-augmented and nonheat-augmented) of the heat exchanger 10 must be attended to by structure which will operate efficiently including, of course, that of locating the compressor 39 in the compartment or chamber 35 such that the heat generated thereby can be dissipated upon the operation of the fan 43.

In order to achieve the foregoing ends, and particularly that of assuring that the flames F are not extinguished during the heat-augmented mode of operation of the heat exchanger 10 by high winds blowing into the chambers 34, 35 through the spaces S1, S2, means 70 are provided for restricting the flow of air into the housing 11 through the spaces S1, S2. The means 70 constitute air flow restricting means in the form of an air deflecting panel or baffle disposed in generally surrounding spaced telescopic relationship to the upper peripheral end portion 25 of the housing 11 and to the peripheral skirt 14 of the cover 12. The air deflecting panel or baffle 70 includes an upwardly directed leg 71, a downwardly directed leg 72, and a bight or wall 73 therebetween which is disposed in a generally horizontal plane. The wall 71 is in generally parallel spaced relationship to the panels 15 through 18 of the cover 12 and thus defines a third space S3 therebetween. Similarly, the horizontal wall portion 73 is below and spaced from a terminal edge (unnumbered) of the terminal edges of the panels 15 through 18 of the cover 12 thereby defining another space S4 therebetween. Accordingly, for air and particularly high winds to enter into the chambers 34, 35, and particularly the chamber 34, the air must follow the generally sinusoidal path into and through the spaces S3, S4, S2, and thence the space S1 into the chambers 34 and 35. The baffle 70 makes such traverse of high speed air or winds difficult if not impossible and virtually precludes such winds from extinguishing the flames F of the gas burner 41 during the heat-augmented mode of operation of the heat exchanger 10.

Obviously, in the same heat-augmenting mode of operation of the heat exchanger 10, any winds which impinge exteriorly upon the door 28 simply urge the same into a closed position relative to the opening 27. Thus, the door 28 also precludes high winds from entering into the chamber 35 through the opening 27 and thence entering reversely through the outlet of the fan 43 into the chamber 34 to adversely effect the flames F.

Obviously, when the heat exchanger 10 is operating in its nonheat-augmenting mode (flames F extinguished and burner 41 inoperative), sufficient air can still be drawn through the spaces S3, S4, S2, S1 from the exterior, across and into the upper portions (unnumbered) of the chambers 34, 35 and thence into and through the coil 40 and over the compressor 39. Those air streams which pass through the coils of the "A-coil" have drawn therefrom heat in a conventional manner as described in the latter-noted applications and under the influence of the fan 43, such heat-depleted air is blown along the air stream S against and to open the door 28 thus exiting the air from the chamber 35 to atmosphere through the opening 28. This same air stream S also, of course, draws the air downwardly across the compressor 39, as is indicated by the unnumbered headed arrows associated therewith in FIG. 2, to also dissipate the heat generated by the compressor and drive the same to atmosphere through the opening 27. Thus, the latter operation is extremely efficient permitting the flow of an appreciable volume of air through the chambers 34, 35 of the housing 11 during the nonheat-augmented mode of operation of the heat exchanger 10.

The overall operation of the heat exchanger 10 corresponds to that set forth in the latter-noted applications, and further details in regard to the specifics thereof may be had to the latter applications. However, in keeping with the invention just described the significant factors are the provisions of the various elements which define the two chambers 34, 35, the manner in which the fan draws the air through the "A-coil" 40 and directs the same outwardly through the opening 27 while opening the hinge door 28. Obviously, the converse is true, namely, while the fan 43 is inoperative due to the de-energization of the motor 42, any exterior winds are precluded from indiscriminately entering the interior of the housing 11 due to the air flow restricting means 70 and the tendency of any air impinging against the exterior of the door 28 to close the same. Thus, high winds exterior of the heat exchanger 10 preclude the flames F from being blown out and otherwise preclude unrestricted, generally speaking, air flow through the spaces S1 through S4.

Although only a preferred embodiment of the invention has been specifically illustrated and described herein, it is to be understood that minor variations may be made in the apparatus without departing from the spirit and scope of the invention, as defined in the appended claims.

I claim:

1. A housing for a heat exchanger comprising a generally upstanding peripheral wall, partition means for setting off a pair of chambers within said housing, first means for admitting ambient air from the exterior of said housing into a first of said pair of chambers, second means for admitting air from a second of said pair of chambers to the exterior of said housing, third means for admitting ambient air from the exterior of said housing into said second chamber, means for normally closing said second air admitting means, and means for creating air flow along first and second flow paths in said respective first and second chambers and conducting air along said first flow path from said first chamber into said second chamber and thereafter directing the air toward said closing means to open said closing means and maintaining it opened under the combined effects of the air flow of both flow paths to effectively discharge air of both flow paths from said second chamber through said second air admitting means to atmosphere.

2. The housing as defined in claim 1 including coil means for conducting therethrough a heat exchange medium, located in said flow path.

3. The housing as defined in claim 1 including coil means for conducting therethrough a heat exchange medium, and said coil means being located in said flow path in said first chamber.

4. The housing as defined in claim 1 including coil means for conducting therethrough a heat exchange medium, and said coil means being located in said flow path in said first chamber between said air flow creating and air conducting means and said first admitting means.

5. The housing as defined in claim 1 wherein said air flow creating and air conducting means includes a fan.

6. The housing as defined in claim 1 wherein said air flow creating and air conducting means includes a fan in said first chamber.

7. The housing as defined in claim 1 wherein said air flow creating and air conducting means includes a fan in said first chamber having an outlet in said second chamber.

8. The housing as defined in claim 1 wherein said air flow creating and air conducting means includes a fan in said first chamber having an outlet in said second chamber and which is directed toward said closing means.

9. The housing as defined in claim 1 wherein said air flow creating and air conducting means includes a fan in said first chamber having an outlet in said second chamber opening through said partition means and directed toward said closing means.

10. The housing as defined in claim 1 wherein said air flow creating and air conducting means includes a fan in said first chamber having an outlet in said second chamber opening through said partition means and directed toward said closing means, and said closing means being a hinged door normally closing said second air admitting means but being movable therefrom to an open position by said air flow.

11. The housing as defined in claim 1 wherein said first and second air admitting means are disposed at generally opposite ends of said housing.

12. The housing as defined in claim 1 wherein said first and second air admitting means are disposed at different elevations.

13. The housing as defined in claim 1 wherein said first and second air admitting means are disposed at generally opposite ends of said housing and are disposed at different elevations.

14. The housing as defined in claim 1 including coil means for conducting therethrough a heat exchange medium, said coil means being in said flow path, said air flow creating and air conducting means including a fan, eans for selectively energizing and de-energizing said fan for respectively establishing and terminating said air flow, means for generating an open flame adjacent said coil means for heating the heat exchange medium, and means for selectively de-energizing and energizing said flame generating means when said fan is respectively energized and de-energized.

15. The housing as defined in claim 14 wherein said coil means is located in said first chamber.

16. The housing as defined in claim 14 wherein said coil means and open flame generating means are located in said first chamber.

17. The housing as defined in claim 14 wherein said coil means, said open flame generating means and said fan are located in said first chamber.

18. The housing as defined in claim 14 wherein said fan has an outlet directed toward said closing means whereby air flow opens the latter.

19. The housing as defined in claim 14 wherein said fan has an outlet directed toward said closing means whereby air flow opens the latter, and said closing means is a hinged door.

20. The housing as defined in claim 18 wherein said first and second air admitting means are disposed at generally opposite ends of said housing.

21. The housing as defined in claim 18 wherein said first and second air admitting means are disposed at different elevations.

22. The housing as defined in claim 18 wherein said first and second air admitting means are disposed at generally opposite ends of said housing and are disposed at different elevations.

23. The housing as defined in claim 18 including means for restricting the flow of air into said first chamber.

24. The housing as defined in claim 18 including a cover over said peripheral wall in relative spaced relationship thereto and in part defining said first air admitting means.

25. The housing as defined in claim 24 including means for restricting the flow of air into said first chamber through said first air admitting means.

26. The housing as defined in claim 1 wherein said first and third air admitting means are disposed at generally the same end of said housing, and said first and second air admitting means are disposed at generally opposite ends of said housing.

27. The housing as defined in claim 26 wherein said first and third air admitting means are located at an uppermost end of the housing.

28. The housing as defined in claim 1 wherein the air flow along the first and second flow paths is at least in part in the same general direction.

* * * * *